US011981475B2

(12) United States Patent
Jiang

(10) Patent No.: US 11,981,475 B2
(45) Date of Patent: May 14, 2024

(54) STORAGE BOX AND PACKAGING STRUCTURE THEREOF

(71) Applicant: YIXIANG BLOW MOLDING FURNITURE CO., LTD., Yuyao (CN)

(72) Inventor: Jinglei Jiang, Yuyao (CN)

(73) Assignee: YIXIANG BLOW MOLDING FURNITURE CO., LTD., Yuyao (CN)

( * ) Notice: Subject to any disclaimer, the term of this patent is extended or adjusted under 35 U.S.C. 154(b) by 0 days.

(21) Appl. No.: 17/553,608

(22) Filed: Dec. 16, 2021

(65) Prior Publication Data

US 2023/0117878 A1 Apr. 20, 2023

(30) Foreign Application Priority Data

Oct. 20, 2021 (CN) ..... 202111224716.6

(51) Int. Cl.
*B65D 6/24* (2006.01)
*B65D 25/04* (2006.01)
*B65D 43/16* (2006.01)

(52) U.S. Cl.
CPC ..... *B65D 11/1873* (2013.01); *B65D 25/04* (2013.01); *B65D 43/165* (2013.01)

(58) Field of Classification Search
CPC ..... B65D 11/1873; B65D 11/1866; B65D 11/1893; B65D 43/165; B65D 43/161; B65D 25/04
USPC .... 220/4.33, 4.28, 6, 7, 4.34, 810, 553, 532, 220/533
See application file for complete search history.

(56) References Cited

U.S. PATENT DOCUMENTS 3,984,023 A * 10/1976 Hodas ..... B65D 11/1873 220/532
4,448,292 A * 5/1984 Comfort ..... A45C 5/00 220/4.28
4,720,020 A * 1/1988 Su ..... B65D 11/1826 220/6
5,064,088 A * 11/1991 Steffes ..... A45C 11/20 220/837
5,524,383 A * 6/1996 Sanko ..... A01G 9/20 47/60
2007/0051721 A1* 3/2007 Wu ..... B65D 21/0201 220/23.6
2012/0074158 A1* 3/2012 Lafleur ..... B65D 43/164 220/810
2015/0239613 A1* 8/2015 Hsu ..... B65D 1/22 220/844

(Continued)

*Primary Examiner* — Robert Poon
(74) *Attorney, Agent, or Firm* — Platinum Intellectual Property

(57) ABSTRACT

The present subject matter discloses a plastic storage box with an integrated hinge structure. The plastic storage box comprises a cover board being pivotably connected to a rear board. The cover board is divided into an upper turning portion and a lower turning portion by an embedded groove hinge. When the cover board is coupled to the rear board, the upper turning portion of the cover board is pivotable in relation to the rear board. The embedded groove hinge eliminates the need for a traditional hinge. The remaining boards of the storage box can be detachably connected to their respective adjacent boards. Furthermore, the package volume of the boards for the storage box is compact, the packaging is convenient, and the boards are securely stored during transportation.

9 Claims, 23 Drawing Sheets

(56) References Cited

U.S. PATENT DOCUMENTS

| | | | | |
|---|---|---|---|---|
| 2016/0176577 | A1* | 6/2016 | Frankenberg | B65D 25/06<br>220/533 |
| 2021/0016922 | A1* | 1/2021 | Leng | B65D 43/165 |

* cited by examiner

STORAGE BOX AND PACKAGING STRUCTURE THEREOF

CROSS-REFERENCES TO RELATED APPLICATIONS

This application claims the priority of CN Patent Application No. CN 2021112247166, entitled "STORAGE BOX AND PACKAGING STRUCTURE THEREOF," filed Oct. 20, 2021, which is incorporated herein by reference for all purposes.

TECHNICAL FIELD

The present subject matter is in the field of plastic board assembly. More particularly, embodiments of the present subject matter relate to a plastic storage box with an integrated hinge structure and its packaging structure.

BACKGROUND

Many outdoor backyards have storage boxes for storing garden tools or other stuff, which makes the backyard more tidy and beautiful. These storage boxes generally have large size and they are sold as unassembled boards. Customers need to assemble the box at home by themselves. When assembling the storage box, a customer needs to use hardware tools, such as a screwdriver, screws, to install and attach the connecting boards or panels. The assembly process is time-consuming, laborious and low-efficiency.

When disassembling the storage box, the screws must be removed one by one, which is also inconvenient. Moreover, when screws are needed, it is necessary to reserve mounting holes on the boards when manufacturing them. For precise assembly, the position of these reserved mounting holes must be accurate. Otherwise, it would cause installation failure.

Furthermore, in a typical storage box, the cover board and the rear board are usually connected by a hinge connection structure, thereby realizing the opening and closing of the cover board. Although the hinge connection structure is relatively strong and reliable, it not only has a complex structure, but also requires hinge installation that is troublesome and time-consuming. In addition, the hinge connection structure usually has metal components with relatively high costs.

In addition, when the traditional storage box is packaged for shipping, it often requires excessive packaging volume, which increases the transportation cost. Also, the traditional package can cause movement and damages of the boards during shipping, resulting in product quality issues. In summary, the present storage box structure needs to be further improved

SUMMARY OF THE SUBJECT MATTER

The present subject matter can solve the technical problem as described herein by providing a plastic storage box with an integrated hinge structure and with compact and efficient packing features. The plastic storage box of the present subject matter is easy to install, low-cost, and enables an efficient shipping package in view of the present state of the art.

The technical solution of the present subject matter to solve the afore-mentioned technical problems is: a plastic storage box with an integrated hinge structure that comprises a bottom board, a front board, a rear board, a left board, a right board and a cover board, the cover board being pivotably connected to the rear board. The cover board is divided into an upper turning portion and a lower turning portion by an embedded groove hinge. The lower turning portion is detachably connected to the rear board to form a full rear board of the plastic storage box.

According to some embodiments, the bottom board, the front board, the rear board, the left board and the right board are detachably connected to their respective adjacent boards. According to some embodiments, the plastic storage box further comprises first pins and second sockets disposed on the lower side of the lower turning portion, and first sockets and second pins disposed on the upper side of the rear board, wherein the first pins can be inserted into the corresponding first sockets, and the second pins can be inserted into the corresponding second sockets.

According to some embodiments, the first sockets and/or the second sockets further comprise ribs, and the first pins and/or the second pins further comprise grooves. The ribs can be snapped into the corresponding grooves when the lower turning portion is connected to the rear board.

According to some embodiments, the inner side of the upper turning portion has an upper inclined surface connected with one side of the embedded groove hinge. The inner side of the lower turning portion has a lower inclined surface connected with the other side of the embedded groove hinge.

According to some embodiments, the upper inclined surface can abut against the lower inclined surface to prevent the upper turning portion and the lower turning portion from collapsing into each other when the upper turning portion and the lower turning portion are perpendicular to each other.

According to some embodiments, the inner surface of the upper turning portion further comprises inwardly extending stopper stripes. The inner surface of the lower turning portion further comprises stopper bars.

According to some embodiments, the inwardly extending stopper stripes can abut against the stopper bars to prevent the upper turning portion and the lower turning portion from collapsing into each other when the upper turning portion and the lower turning portion are perpendicular to each other.

According to some embodiments, the plastic storage box further comprises a vertical partition board within the plastic storage box, wherein the bottom of the vertical partition board is fastened to the bottom board. The top of the vertical partition board can abut against a stripe-shaped rib on the upper turning portion when the cover board is closed.

According to some embodiments, the plastic storage box further comprises limiting ribs protruding on the inner bottom surface of the bottom board, limiting slots embedded in the bottom of the vertical partition board, wherein the limiting ribs can be inserted into the limiting slots.

According to some embodiments, the cover board has an arched structure with an uneven top. The side board, left board and right board further comprise water resisting strips.

According to some embodiments, the plastic storage box further comprises a spring connecting each of the left board and the right board with the cover board.

According to some embodiments, in the storage box packaging state, the lower turning portion of the cover board is installed on the rear side of the bottom board, and the upper turning portion of the cover board is folded to the top of the bottom board, the individual panels of the plastic storage box can form a an installation cavity formed between the upper turning portion, the lower turning portion, the bottom board, and the front side board. The rear board, the left board, and the right board are stacked in the installation cavity in the storage box packaging state.

According to some embodiments, in the packaging state, the front board is stacked on the bottom board, the rear board is stacked on the front board, the left board and the right board are stacked on the front board in the storage box packaging state.

According to some embodiments, the plastic storage box further comprises lateral limiting grooves provided on the inner side wall of the lower turning portion, water resisting stripes provided on the left board, right board. The water resisting stripes are embedded in the corresponding lateral limiting grooves in the storage box packaging state.

According to some embodiments, the plastic storage box further comprises sockets provided on the bottom board, and pins provided on the lower turning portion of the cover board. The pins can be inserted into the sockets in the storage box packaging state.

According to some embodiments, the plastic storage box further comprises a transverse support rod installed on the upper turning portion, a lock, a water resisting stripe. The lock and the water resisting stripe can support the upper turning portion in the storage box packaging state.

According to some embodiments, when the storage box is installed, the vertical partition board is vertically arranged on the bottom board. When the storage box is packaged, the vertical partition board is stacked horizontally on the bottom board.

According to some embodiments, the plastic storage box further comprises limiting ribs protruding on the inner bottom of the bottom board, second limiting slots. The limiting ribs can lock into the second limiting slots in the storage packaging state.

Compared with the prior art, the advantages of the present subject matter include creating an embedded groove hinge dividing a cover board into an upper turning portion and a lower turning portion, which are pivotable by the embedded groove hinge. When the cover board is coupled to the rear board, the lower turning portion of the cover board is mated with the rear board to form a full rear board. This way, the upper turning portion of the cover board is pivotable or rotatable in relation to the rear board by the embedded groove hinge. The embedded groove hinge eliminates the need for a traditional hinge. Without any metal components, the present storage box structure is a simple structure with relatively low manufacturing cost. Furthermore, the back view of the storage box is simple and novel due to the elimination of a traditional hinge.

In addition, the package volume of the boards for the storage box is compact. The packaging is convenient, and the boards are securely stored during the transportation.

Other aspects and advantages of the present subject matter will become apparent from the following detailed description taken in conjunction with the accompanying drawings, which illustrate, by way of example, the principles of the present subject matter.

DESCRIPTION OF DRAWINGS

The present subject matter is illustrated by way of example, and not by way of limitation, in the figures of the accompanying drawings and in which.

DETAILED DESCRIPTION

The present subject matter pertains to improved approaches for a screw-free, integrated hinge structure for adjacent plastic boards. Embodiments of the present subject matter are discussed below with reference to FIGS. 1-23.

In the following description, for purposes of explanation, numerous specific details are set forth in order to provide a thorough understanding of the present subject matter. It will be apparent, however, to one skilled in the art that the present subject matter may be practiced without some of these specific details. In addition, the following description provides examples, and the accompanying drawings show various examples for the purposes of illustration. Moreover, these examples should not be construed in a limiting sense as they are merely intended to provide examples of embodiments of the subject matter rather than to provide an exhaustive list of all possible implementations. In other instances, well-known structures and devices are shown in block diagram form in order to avoid obscuring the details of the disclosed features of various described embodiments.

Figure 1:
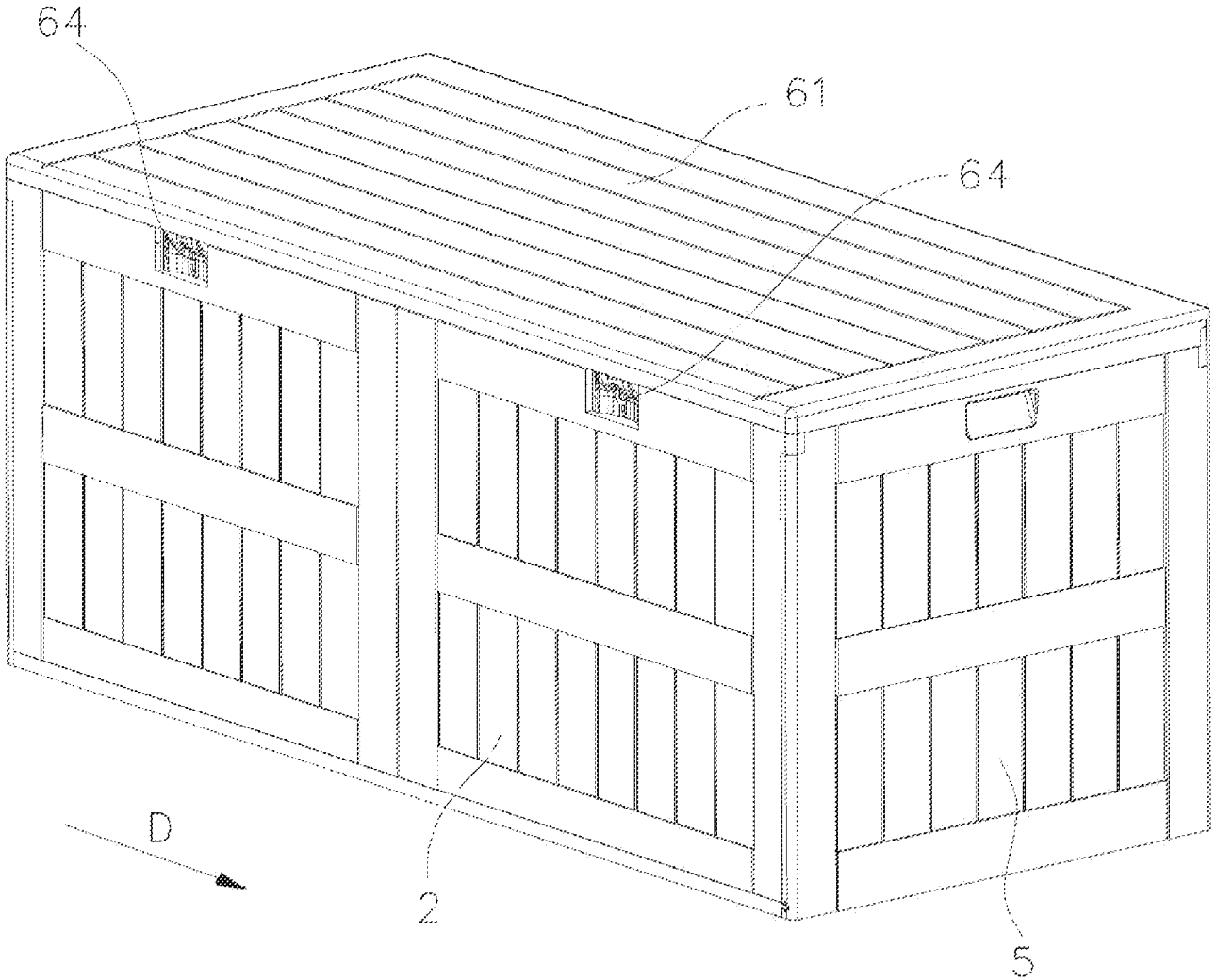
FIG. 1 is a schematic structural view of the storage box when the storage box is in a closed state, according to an embodiment of the present subject matter.
Figure 2:
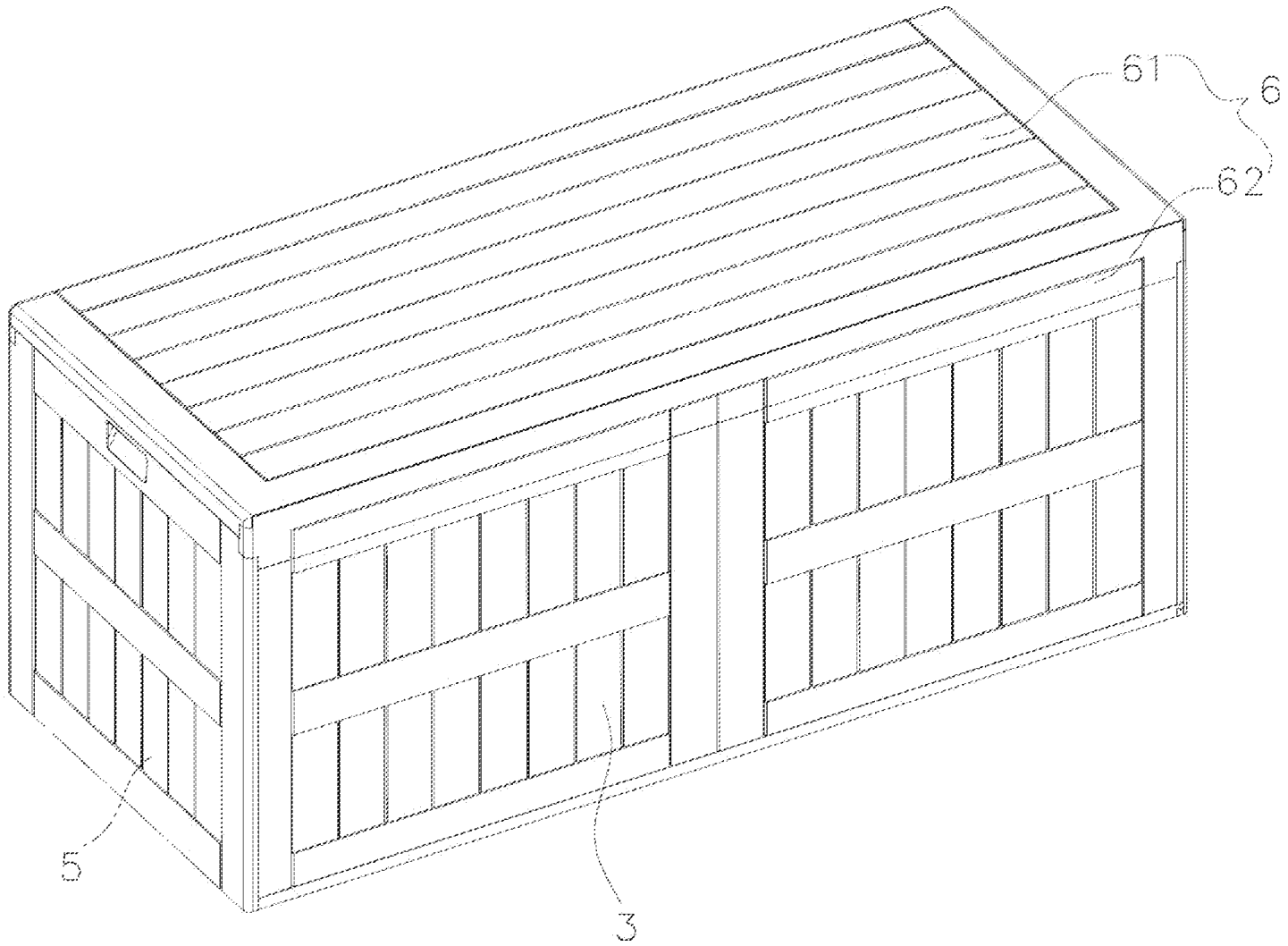
FIG. 2 is a schematic structural view of the storage box shown in FIG. 1 from another angle.

As shown in FIGS. 1 to 5, along the direction indicated by arrow D in FIG. 1, the storage box of this embodiment is a square box, including a bottom board 1, a front board 2, a rear board 3, and a left board 4, a right board 5 and cover board 6. According to some embodiments, the front board 2, the rear board 3, the left board 4, the right board 5 and the cover board 6 can be blow-molded boards that are integrally formed in one-piece, and the bottom board 1 can be an injection-molded board that is integrally formed in one-piece.

According to some embodiments, the bottom board 1, the front board 2, the rear board 3, the left board 4 and the right board 5 can adopt screw-free, plug-in coupling structures with their respective adjacent boards, which is convenient for installation and disassembly. The screw-free, plug-in coupling structure can adopt strip-shaped ribs and strip-shaped grooves that can be interlocked with each other.

The cover board 6 can be pivotably or rotatably connected to the rear board 3. A spring 9 connected to the cover board 6 can be installed on both the left board 4 and the right board 5. Spring 9 can enable the cover board 6 to open and close more easily.

According to some embodiments, a transverse support rod 73 can be installed on the front edge of the cover board 6. A lock 64 can be installed on the transverse support rod 73. The transverse support rod 73 can strengthen the cover board 6 and prevent it from bending. A lock hole 21 can be installed at the corresponding position of the front board 2. When the storage box is closed, the lock catch 64 can pass through the lock hole 21.

According to some embodiments, a vertical partition board 7 can be arranged inside the storage box. The vertical partition board 7 can divide the storage box into two storage areas. The bottom of the vertical partition board 7 can be fixed on the bottom board 1. The front and rear sides of the vertical partition board 7 can be respectively mated with the front board 2 and the rear board 3. In particular, the vertical partition board 7 can have pins that can be inserted into corresponding sockets provided the front board 2 and the rear board 3. As such, connection structures, e.g., pins and sockets, are conventional, without additional descriptions needed.

According to some embodiments, the inner bottom surface of the bottom board 1 can have protruding limiting ribs 11 that are distributed in the left and right directions. The bottom of the vertical partition board 7 can have one or more limiting grooves 71 to couple with the limiting ribs 11. The inner side of the cover board 6 can have strip-shaped ribs 613 corresponding to the vertical partition board 7. When the cover board 6 is closed, the strip-shaped ribs 613 can abut against the vertical partition board 7. As such, the vertical partition board 7 can support the cover board 6 to increase the load-bearing capacity of the cover board 6 and to enhance the stability of the storage box.

According to some embodiments, the vertical partition board 7 can comprise two small partition boards that can be assembled together. According to some embodiments, multiple vertical partition boards 7 can be used not only to strengthen the storage box but also to provide more organized storage space.

Figure 4:
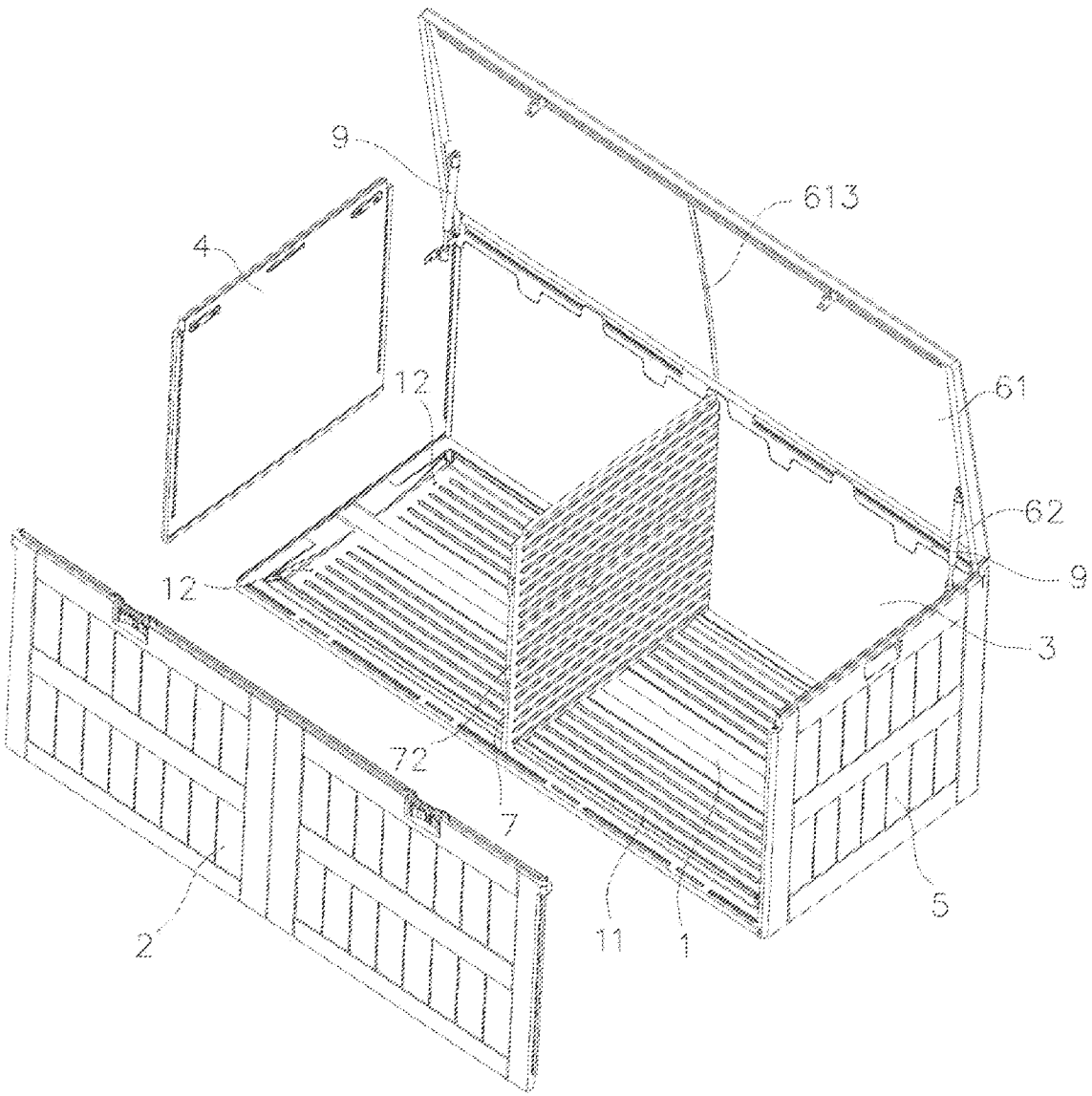
FIG. 4 is an exploded schematic view of the storage box shown in FIG. 3.
Figure 21:
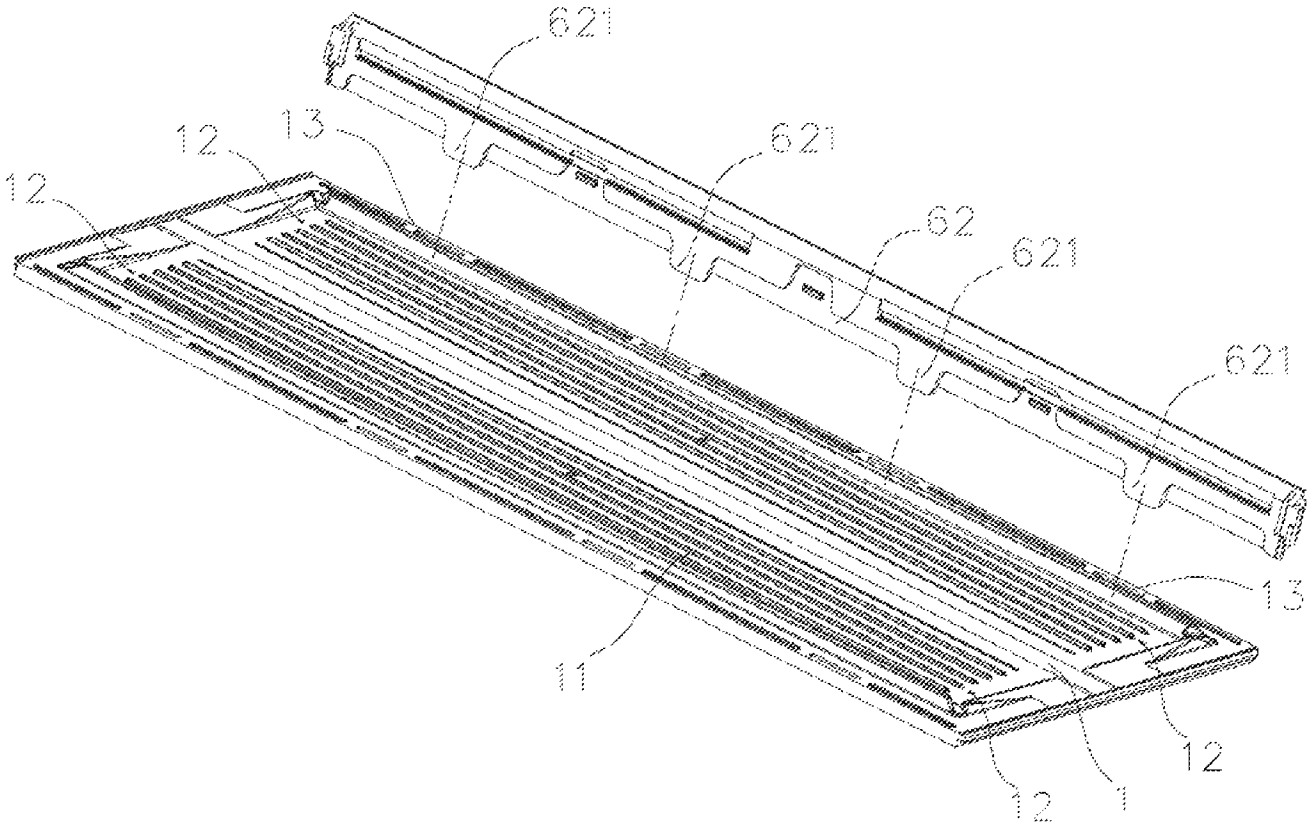
FIG. 21 is a schematic view of the lower folding portion of the cover and the bottom board in the pre-assembly package state according to an embodiment of the present subject matter.

According to some embodiments, as shown in FIGS. 4 and 21, one or more fixation hole 12 can be presented in the bottom board 1. The storage box can be fastened to the ground by screws via fixation hole 12.

According to some embodiments, the storage box can have waterproof features. The cover board 6 can have an arched structure with an uneven top. For example, cover board 6 can have a high rear portion and a low front portion or a high central portion and a low side portion. When the cover board 6 is closed, the uneven top can allow water to flow away from the box and not flow into the box.

As shown in FIGS. 6 to 11, according to some embodiments, an embedded groove hinge 63 can be formed in the inner side of the cover board 6. The embedded groove hinge 63 can have two openings respectively located on opposite sides of the cover board 6, thus dividing the cover board 6 into rotatable upper folding portion 61 and lower folding portion 62. The lower turning portion 62 can be detachably connected to the rear board 3 to form a full rear board of the plastic storage box.

Furthermore, the full rear board is composed of an upper part and a lower part, whereas the upper part is the lower turning portion 62 and the lower part is the rear panel 3. The rear board construction is novel and unique. According to some embodiments, the two-part panel can be adopted by the cover board, instead of the rear board. Accordingly, an embedded groove hinge on the rear board can divide it into two turning portions as described herein.

When the cover board 6 is coupled to the rear board 3, the lower folding portion 62 is mated with the rear board 3 so that the upper folding portion 61 is pivotable or rotatable in relation to the full rear board by the embedded groove hinge 63. The embedded groove hinge 63 can eliminate the need for a traditional hinge. It has a simple structure that is easy to assemble. Without any metal components, the integrated hinge structure has a relatively low manufacturing cost.

Figure 12:
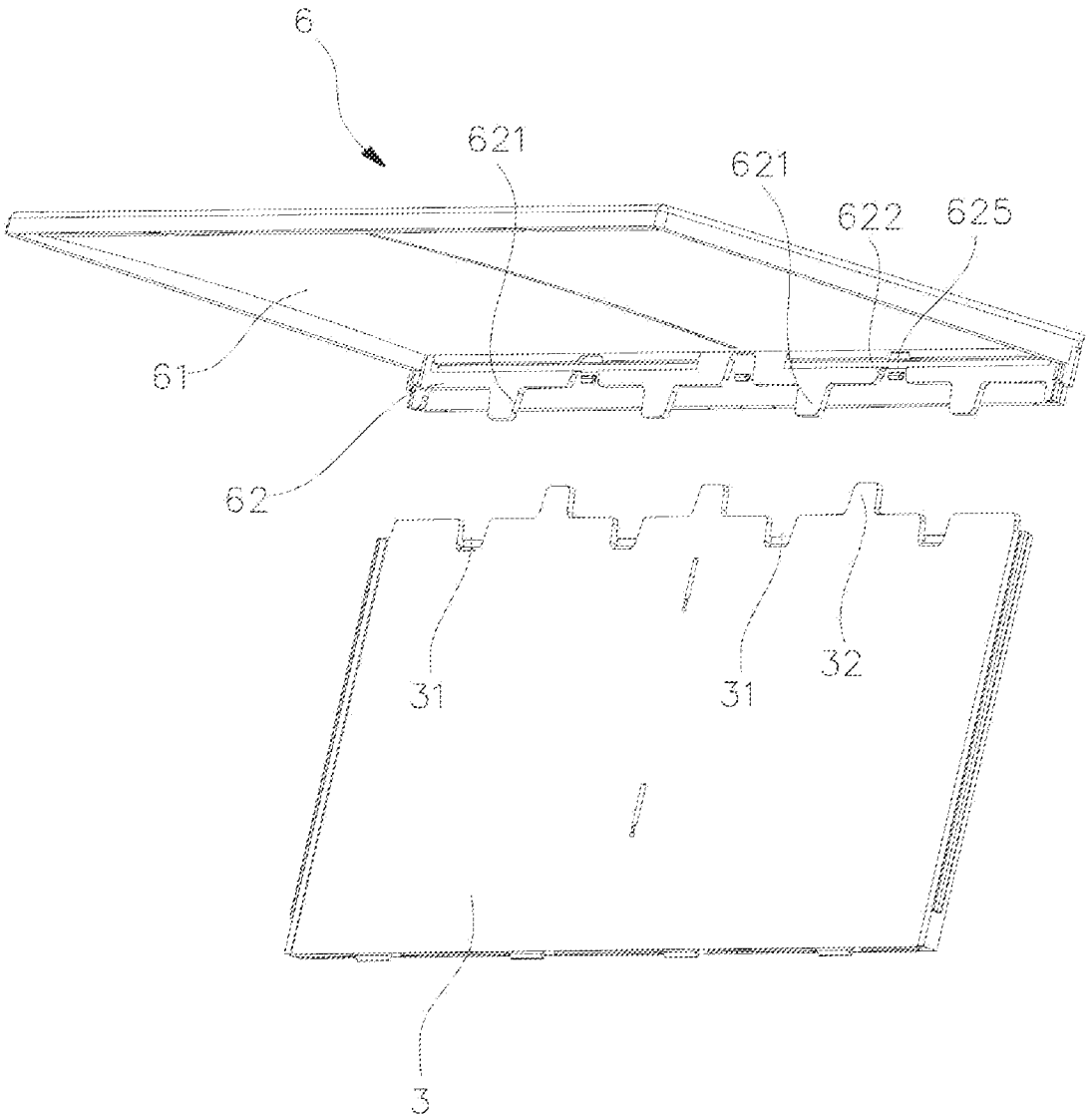
FIG. 12 is an exploded schematic view of the cover board and the rear board according to an embodiment of the present subject matter.
Figure 13:
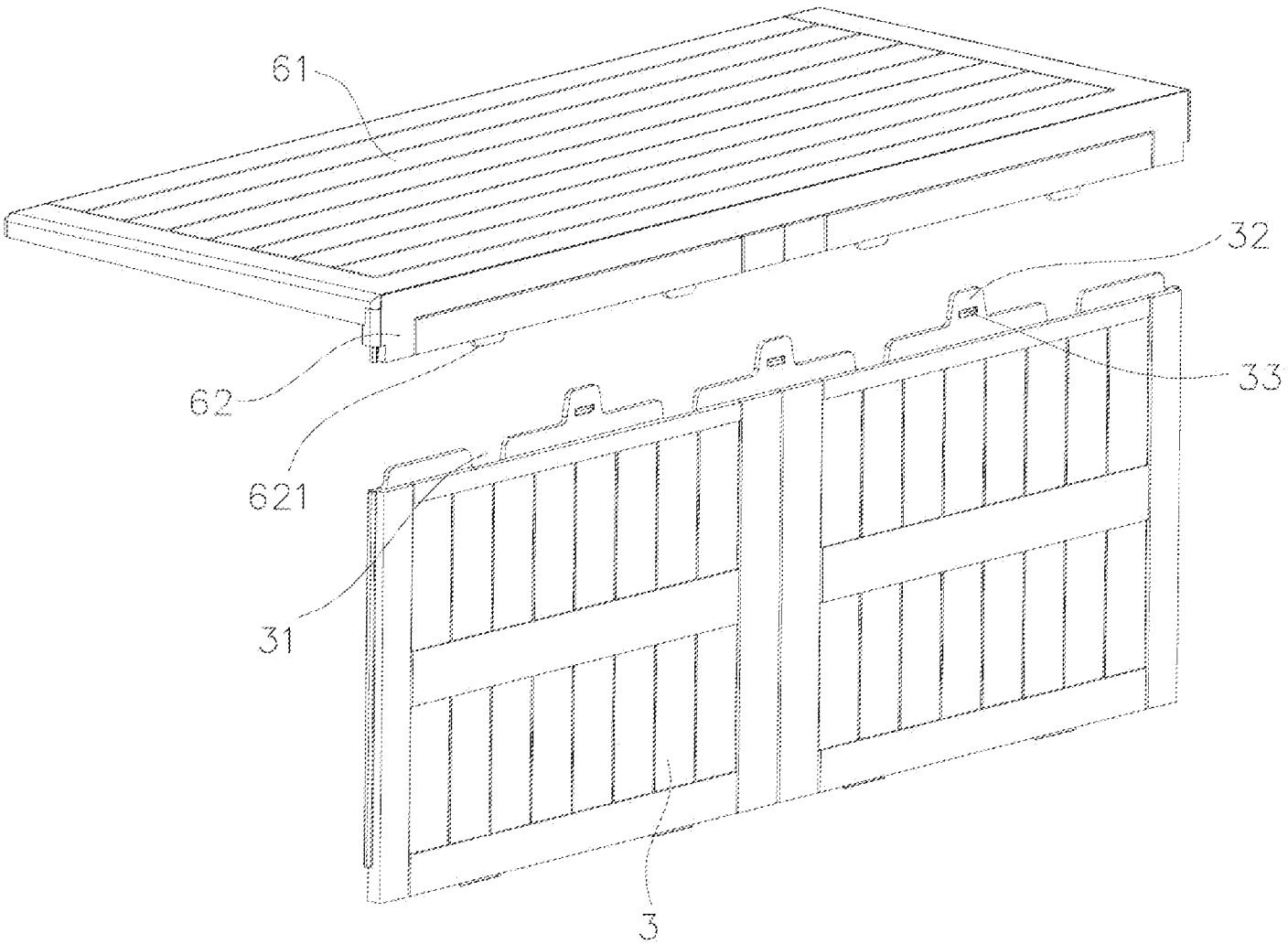
FIG. 13 is a schematic view of FIG. 12 from another angle.
Figure 14:
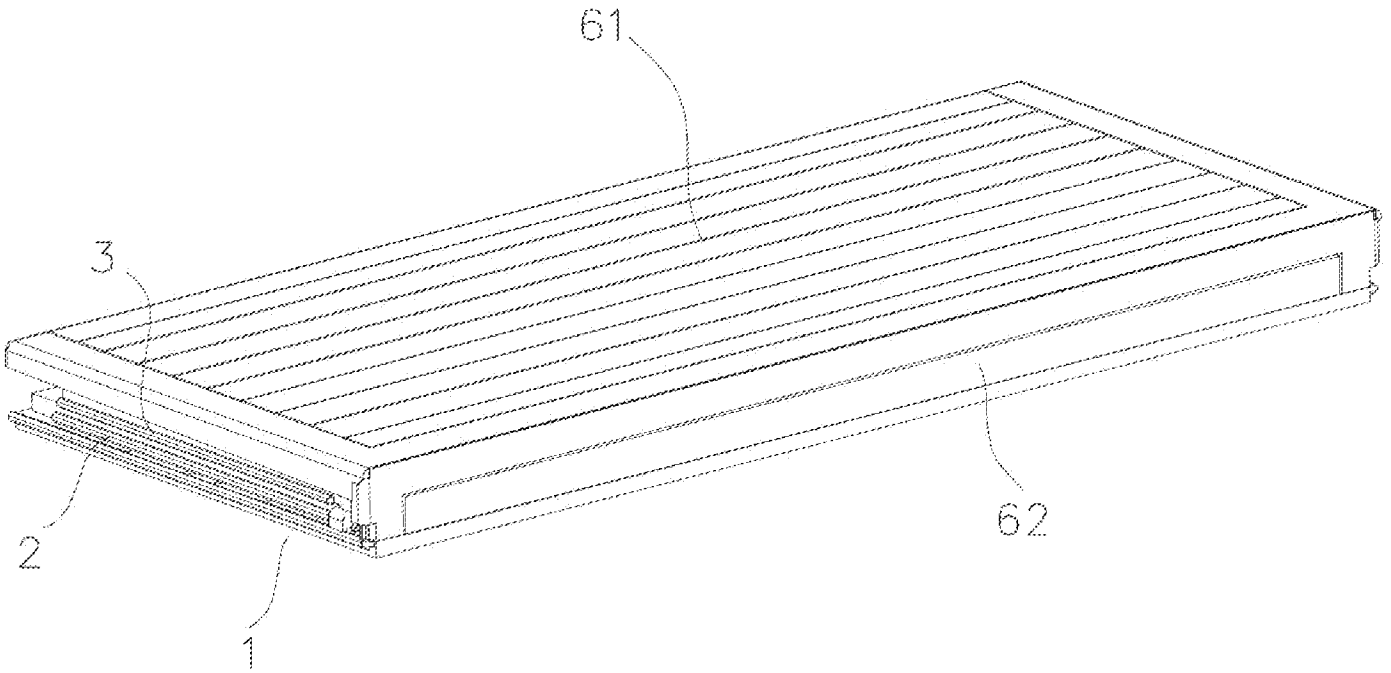
FIG. 14 is a schematic diagram of the storage box in the pre-assembly package state according to an embodiment of the present subject matter.

As shown in FIGS. 12 and 13, the lower turning portion 62 of the cover board 6 and the rear board 3 can adopt a plug-in coupling to form a detachable connection. The specific structure can be: first pins 621 and second sockets 622 disposed on the lower side of the lower turning portion 62, and first sockets 31 and second pins 32 disposed on the upper side of the rear board 3. The first pins 621 can be inserted into the corresponding first sockets 31, and the second pins 32 can be inserted into the corresponding second sockets 622.

According to some embodiments, the first sockets 31 and/or the second sockets 622 can further comprise ribs 625. The first pins 621 and/or the second pins 32 can further comprise grooves 33. The ribs 625 can be snapped into the corresponding grooves 33 when the lower turning portion 62 is connected to the rear board 3 to form the full rear board.

According to some embodiments, the inner side of the upper turning portion 61 can have an upper inclined surface 611 connected with one side of the embedded groove hinge 63. The inner side of the lower turning portion 62 can have a lower inclined surface 623 connected with the other side of the embedded groove hinge 63.

According to some embodiments, the upper inclined surface 611 can abut against the lower inclined surface 623 to prevent the upper turning portion 61 and the lower turning portion 62 from collapsing into each other when the upper turning portion 61 and the lower turning portion 62 are perpendicular to each other.

According to some embodiments, the inner surface of the upper turning portion 61 can further comprise inwardly extending stopper stripes 612. The inner surface of the lower turning portion 62 can further comprise stopper bars 624.

According to some embodiments, the inwardly extending stopper stripes 612 can abut against the stopper bars 624 to prevent the upper turning portion 61 and the lower turning portion 62 from collapsing into each other when the upper turning portion 61 and the lower turning portion 62 are perpendicular to each other.

As shown in FIGS. 14-19, when the storage box is in the packaged state, the lower turning portion 62 of the cover board 6 can be installed on the rear side of the bottom board 1, and the upper turning portion 61 of the cover board 6 can be folded to the top of the bottom board 1. The package structure comprises an installation cavity 10 formed between the upper turning portion 61, the lower turning portion 62, the bottom board 1, and the front side board 2. The rear board 3, the left board 4, and the right board 5 can be stacked in the installation cavity 10 in the storage box packaging state.

Figure 5:
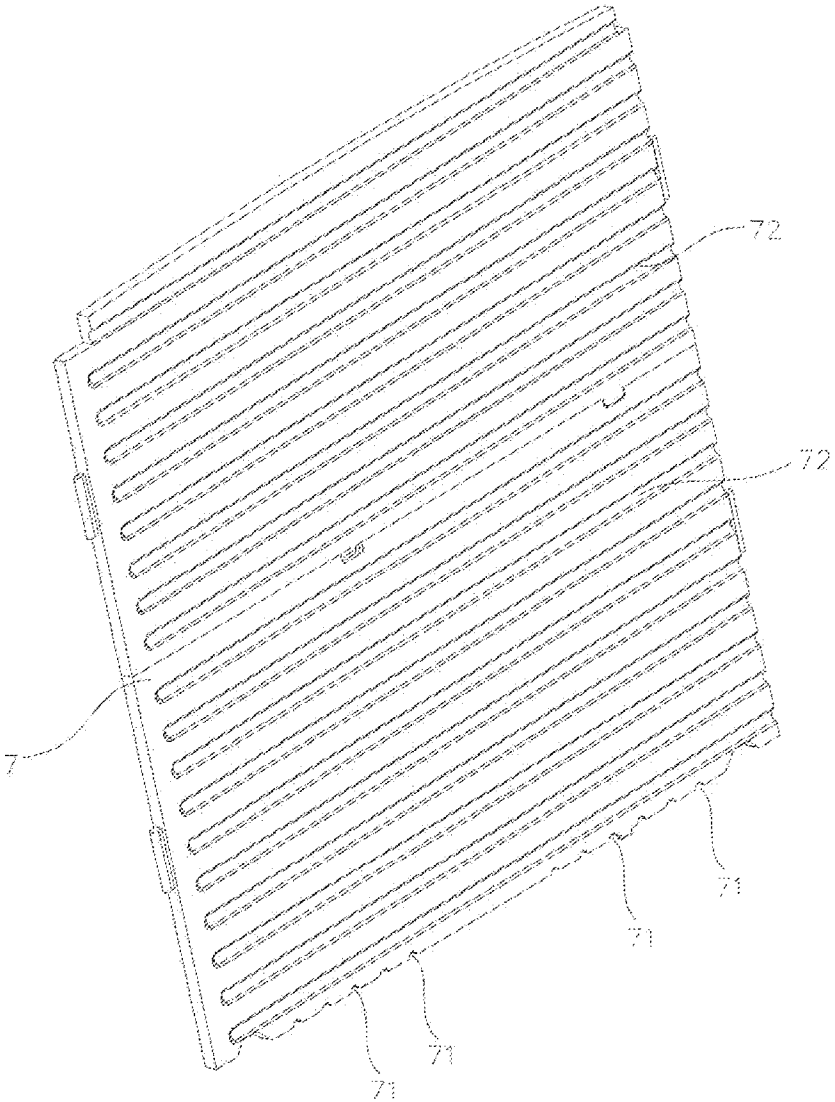
FIG. 5 is a schematic structural view of a vertical partition board according to an embodiment of the present subject matter.
Figure 6:
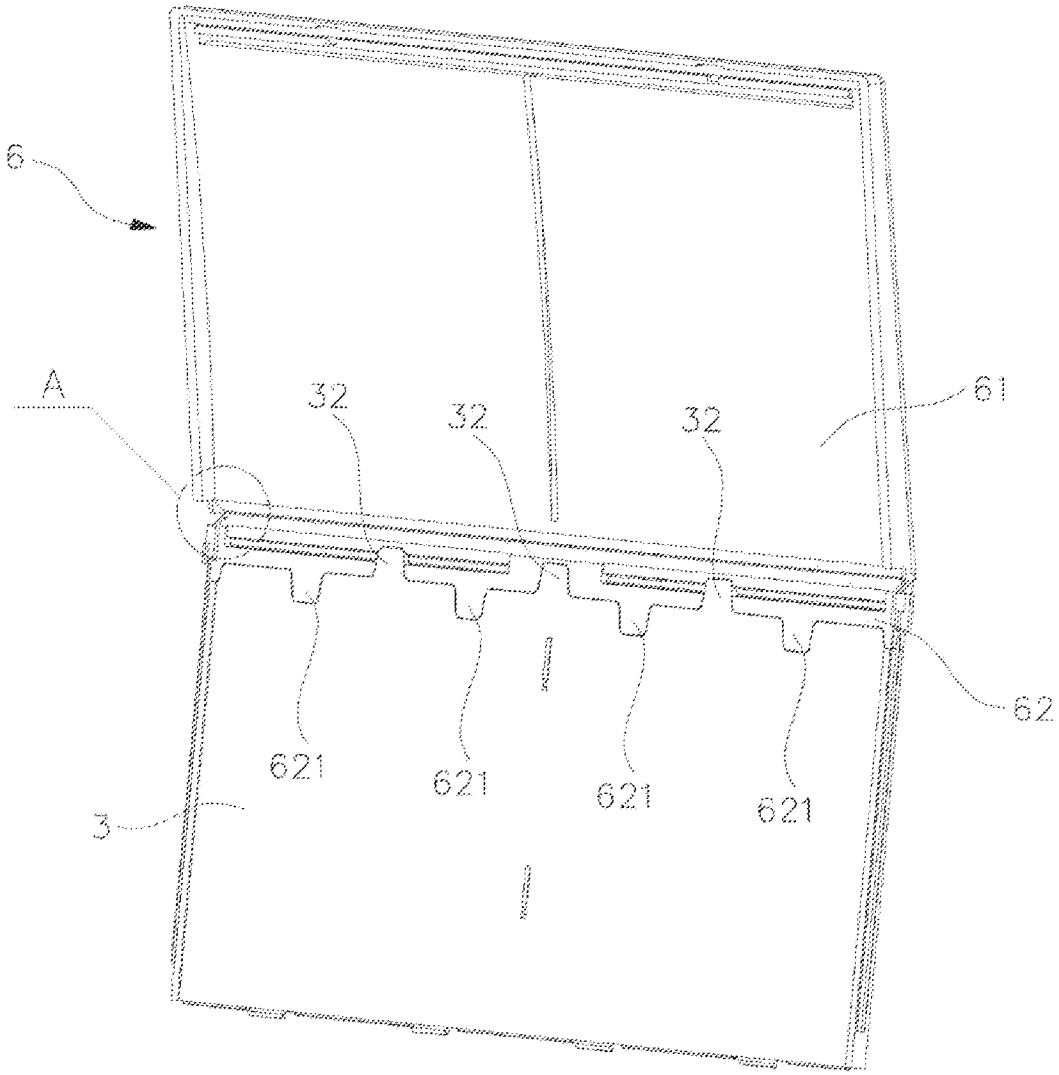
FIG. 6 is a schematic structural view of the storage box when the cover board is open according to an embodiment of the present subject matter.
Figure 7:
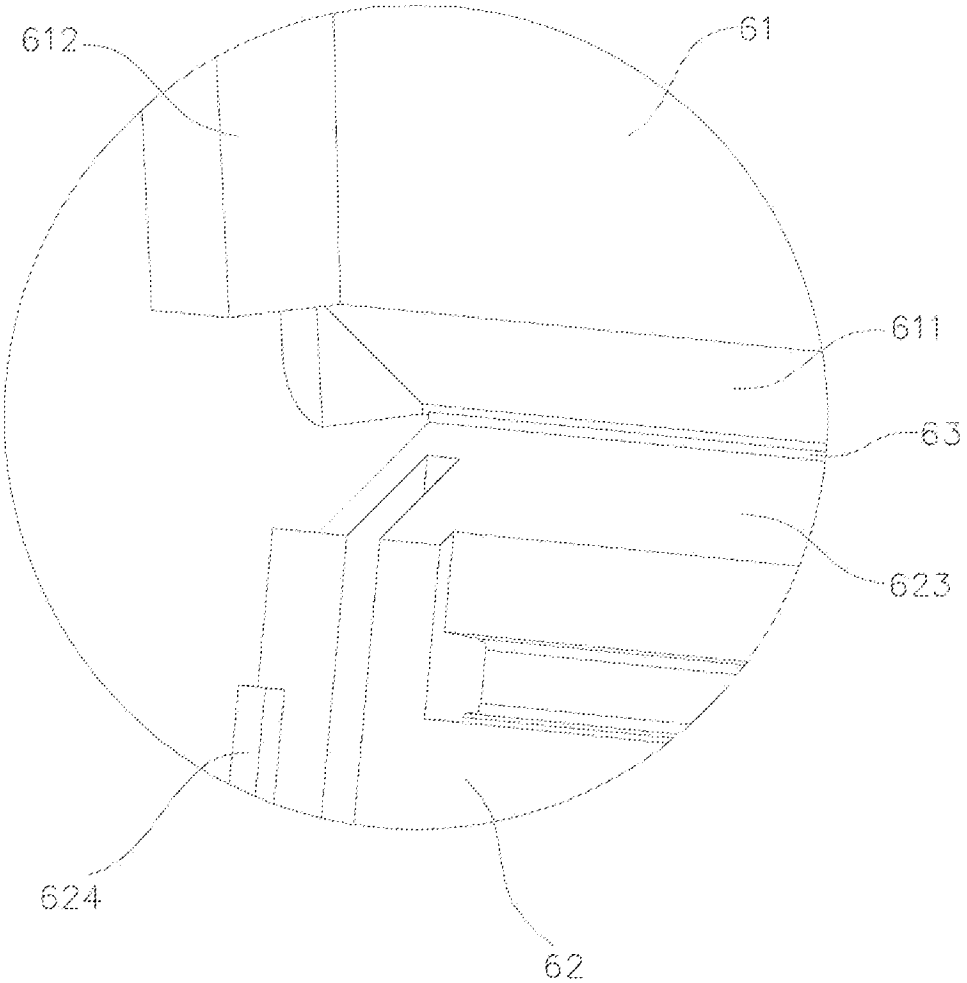
FIG. 7 is an enlarged schematic view of part A in FIG. 1.
Figure 8:
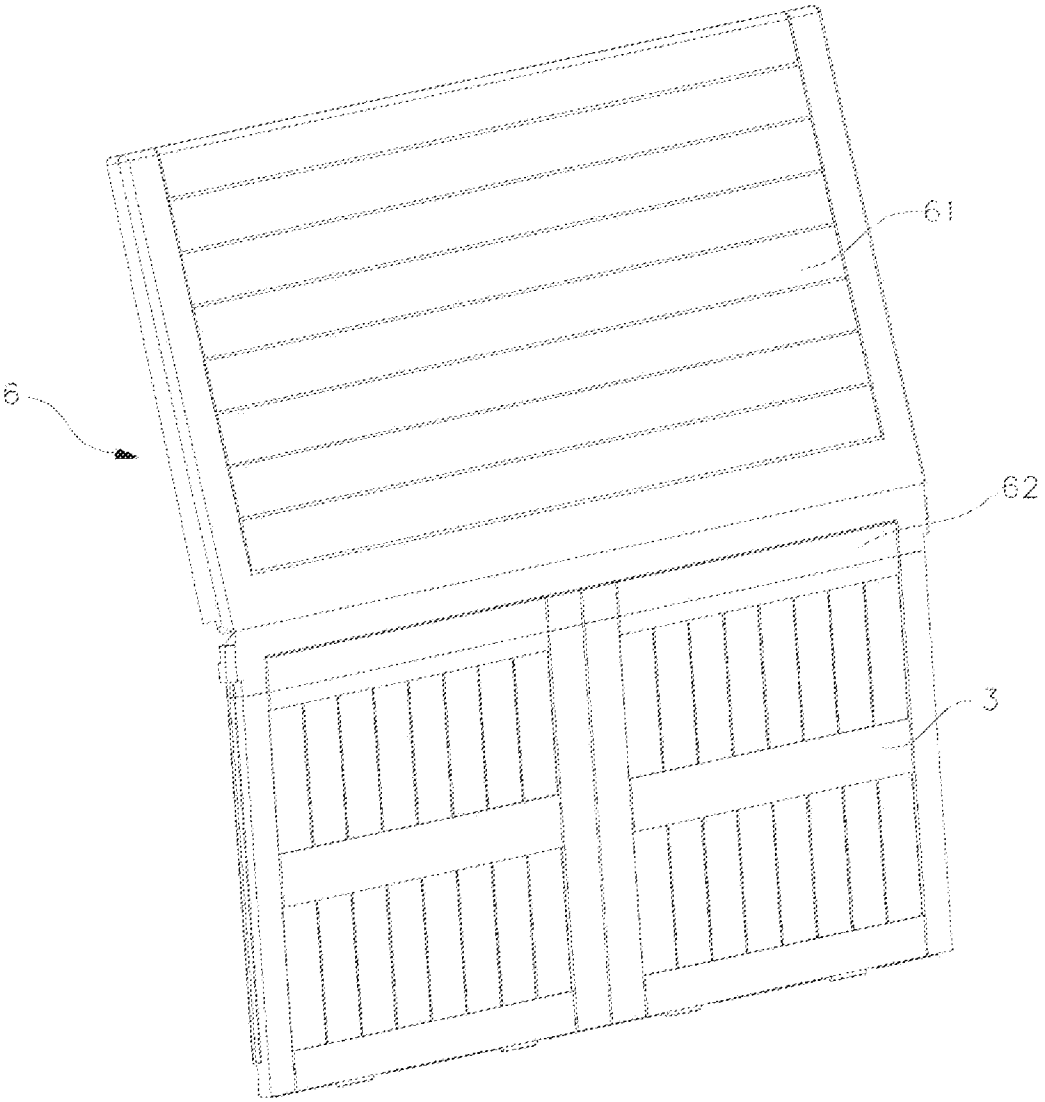
FIG. 8 is a schematic view of the structure of FIG. 6 from another angle.
Figure 9:
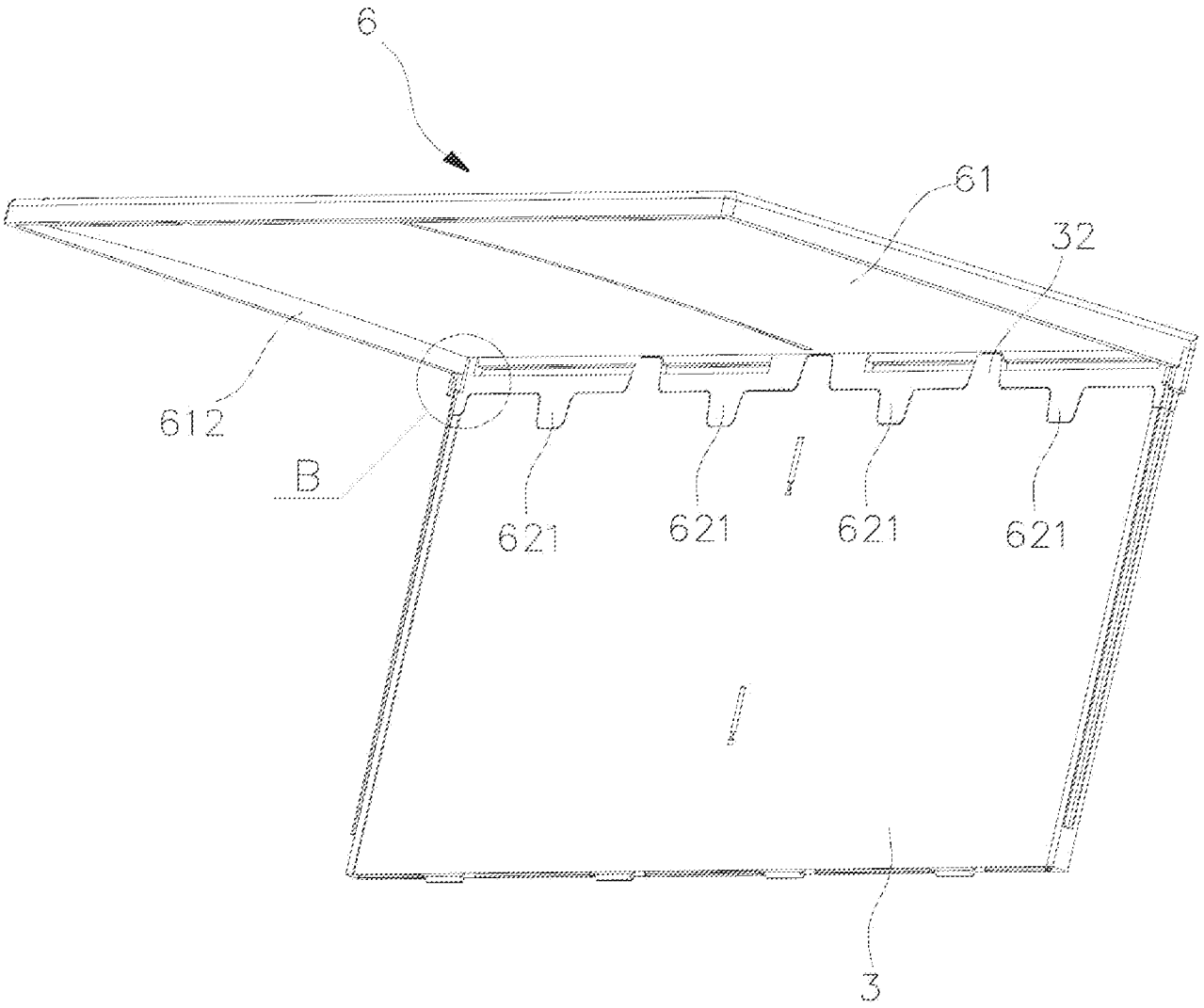
FIG. 9 is a schematic structural view of the storage box when the cover board is closed according to an embodiment of the present subject matter.
Figure 10:
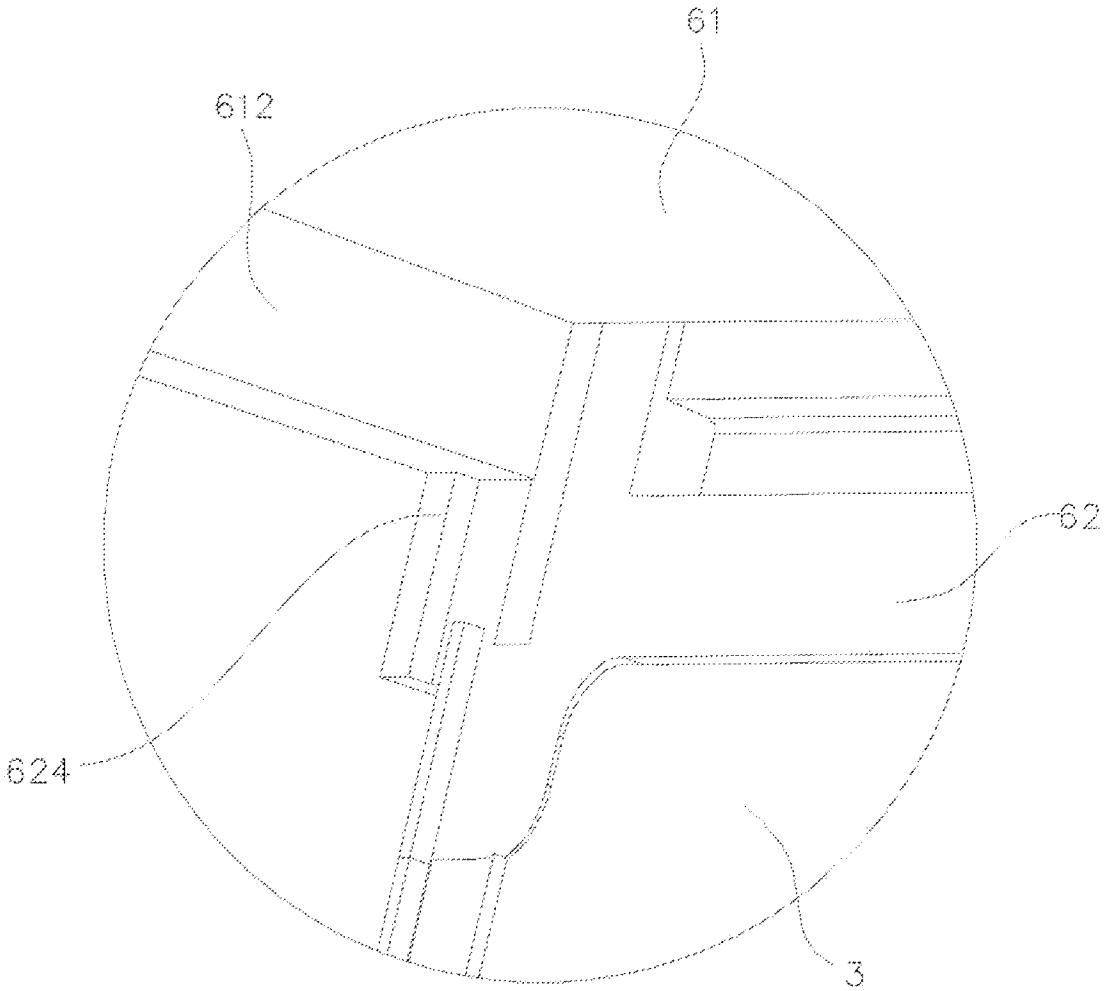
FIG. 10 is an enlarged schematic view of part B in FIG. 9.
Figure 11:
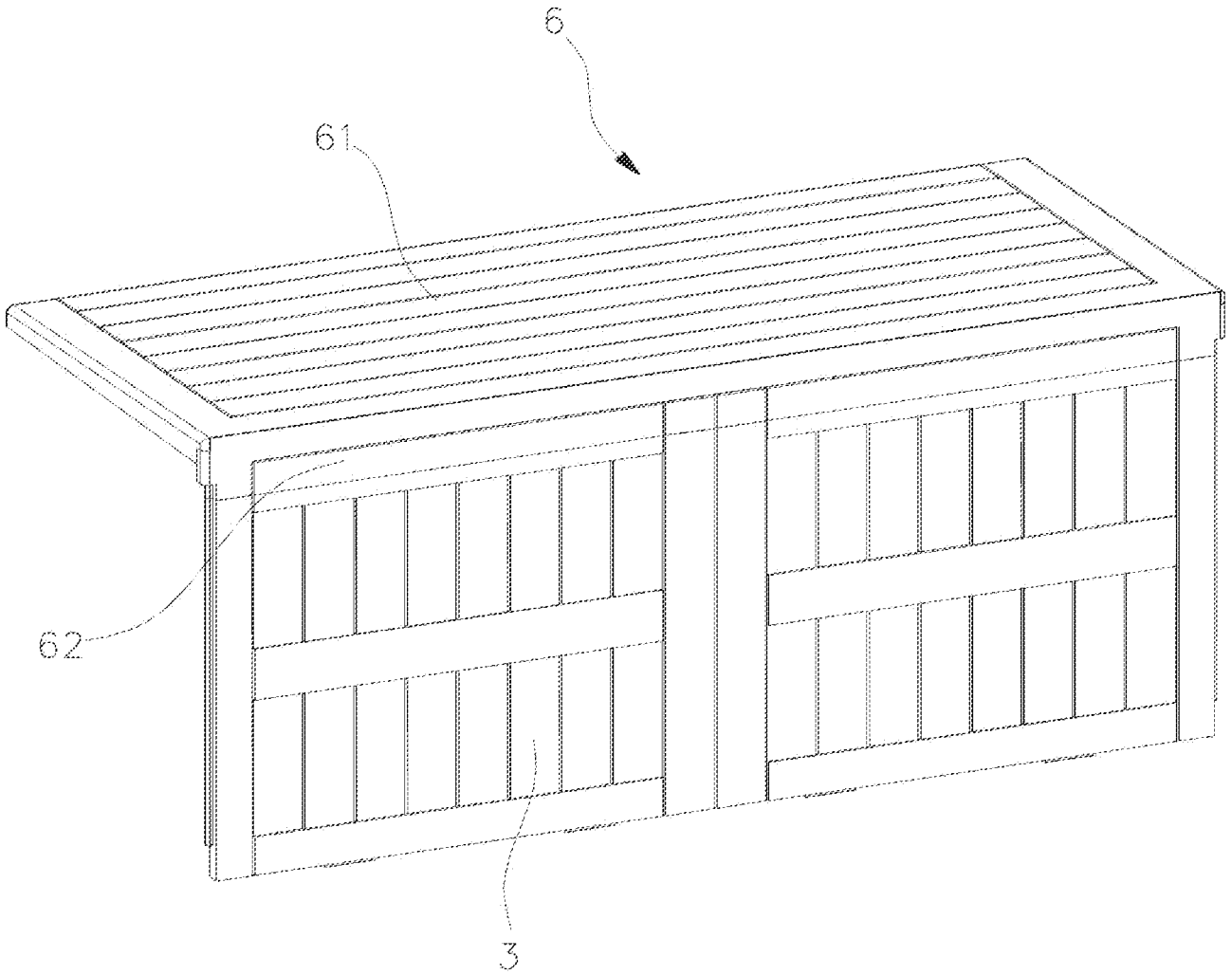
FIG. 11 is a schematic view of FIG. 9 from another angle.
Figure 20:
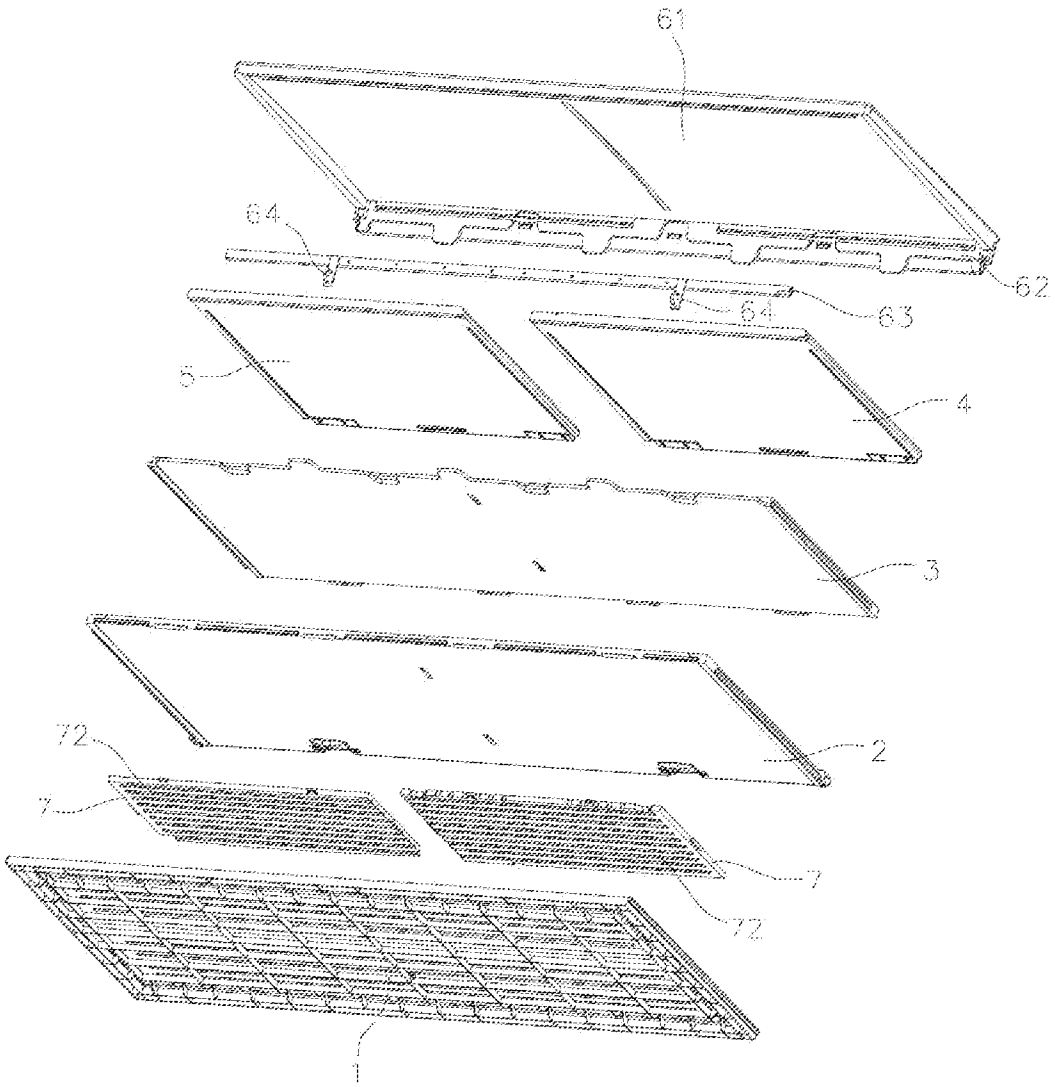
FIG. 20 is a schematic view of FIG. 19 from another angle.

As shown in FIGS. 20 and 21, limiting ribs 11 can be provided between the vertical partition board 7 and the bottom board 1. The limiting ribs 11 can be distributed at intervals from front to back. As shown in FIG. 5, second limiting slot 72 can be formed on the side of the vertical partition board 7. During the storage box packaging state, the limiting ribs 11 can be locked into the second limiting slot 72, thereby locking the vertical partition board 7 on the bottom board 1. It can prevent the vertical partition board 7 from moving forward and backward during transportation.

As shown in FIG. 21, a limit element can be provided between the lower turning portion 62 of the cover board 6 and the bottom board 1. It can be sockets 13 located on the bottom board 1, and first pins 621 located on the lower turning portion 62 of the cover board 6. As shown in FIG. 12, the first pins 621 can insert into the corresponding sockets 13 during the storage packaging state.

Figure 3:
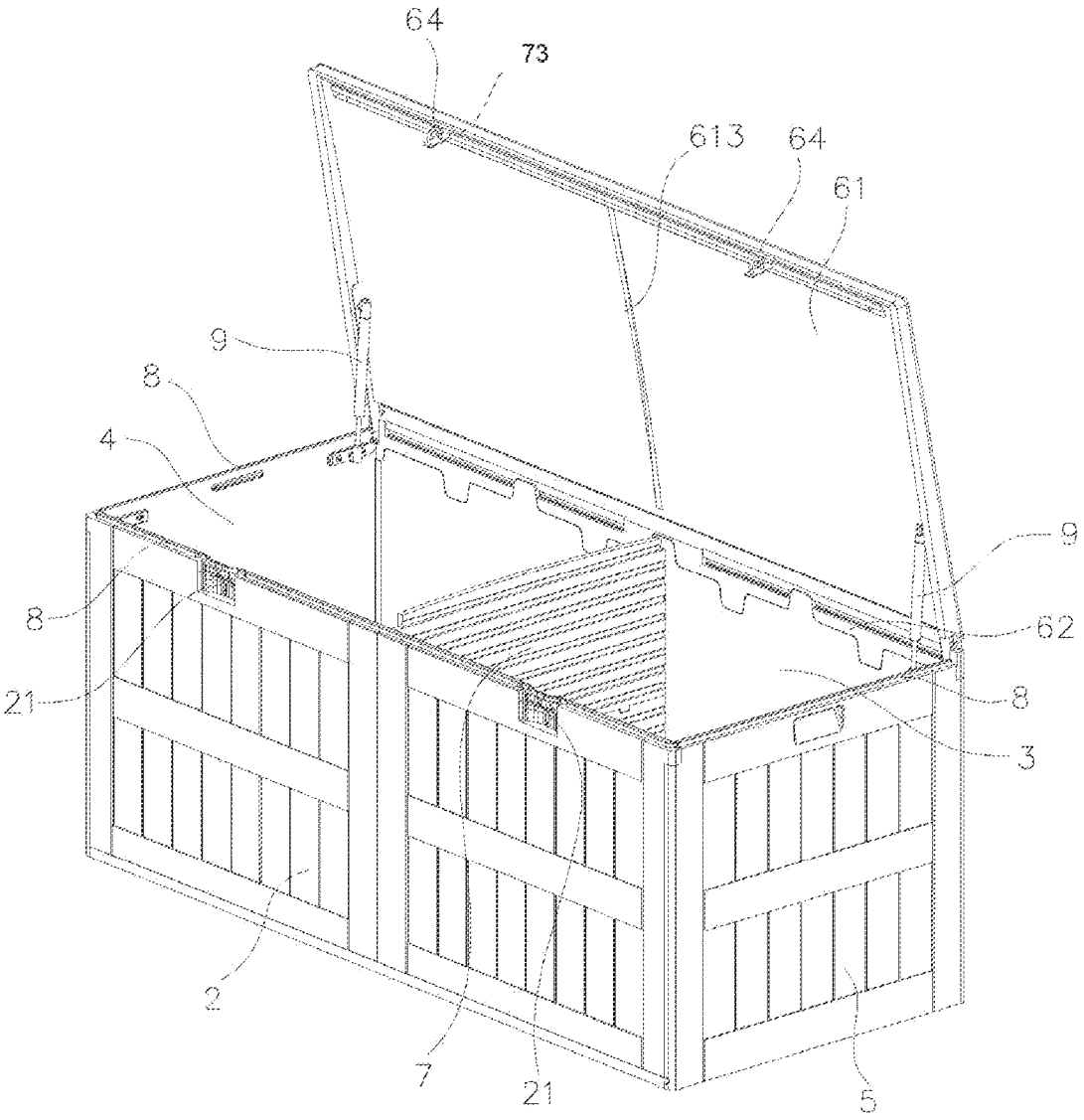
FIG. 3 is a schematic structural view of the storage box in an open state, according to an embodiment of the present subject matter.
Figure 22:
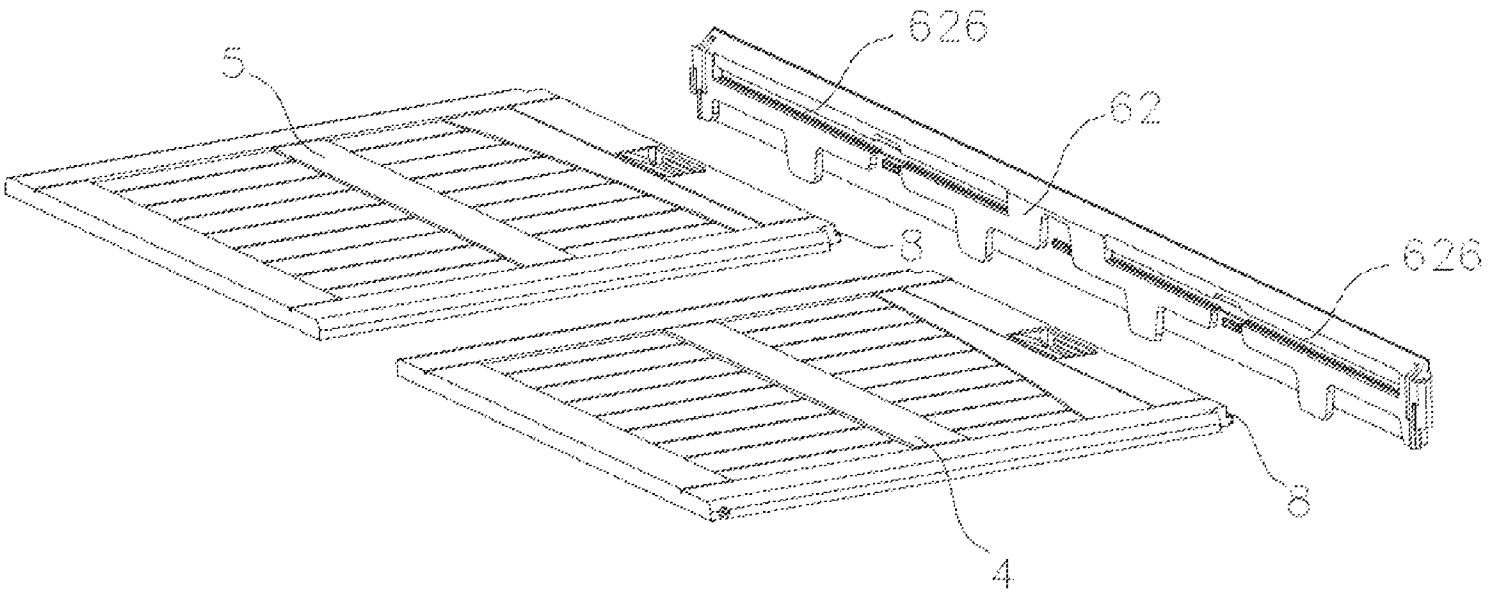
FIG. 22 is a schematic view of the lower folding portion of the cover board and the side boards in the pre-assembly package state according to an embodiment of the present subject matter.

As shown in FIG. 22, a limiting element can be provided for the left board 4, the right board 5, the lower turning portion 62 of the cover board 6. It can be lateral limiting grooves 626 provided on the inner side wall of the lower turning portion 62 and water resisting stripes 8 provided on the left board 4 and right board 5. As shown in FIG. 3, when the storage box is packed, the water resisting stripes 8 are embedded in the corresponding lateral limiting grooves 626. the left board 4 and the right board 5 can be placed horizontally.

Figure 15:
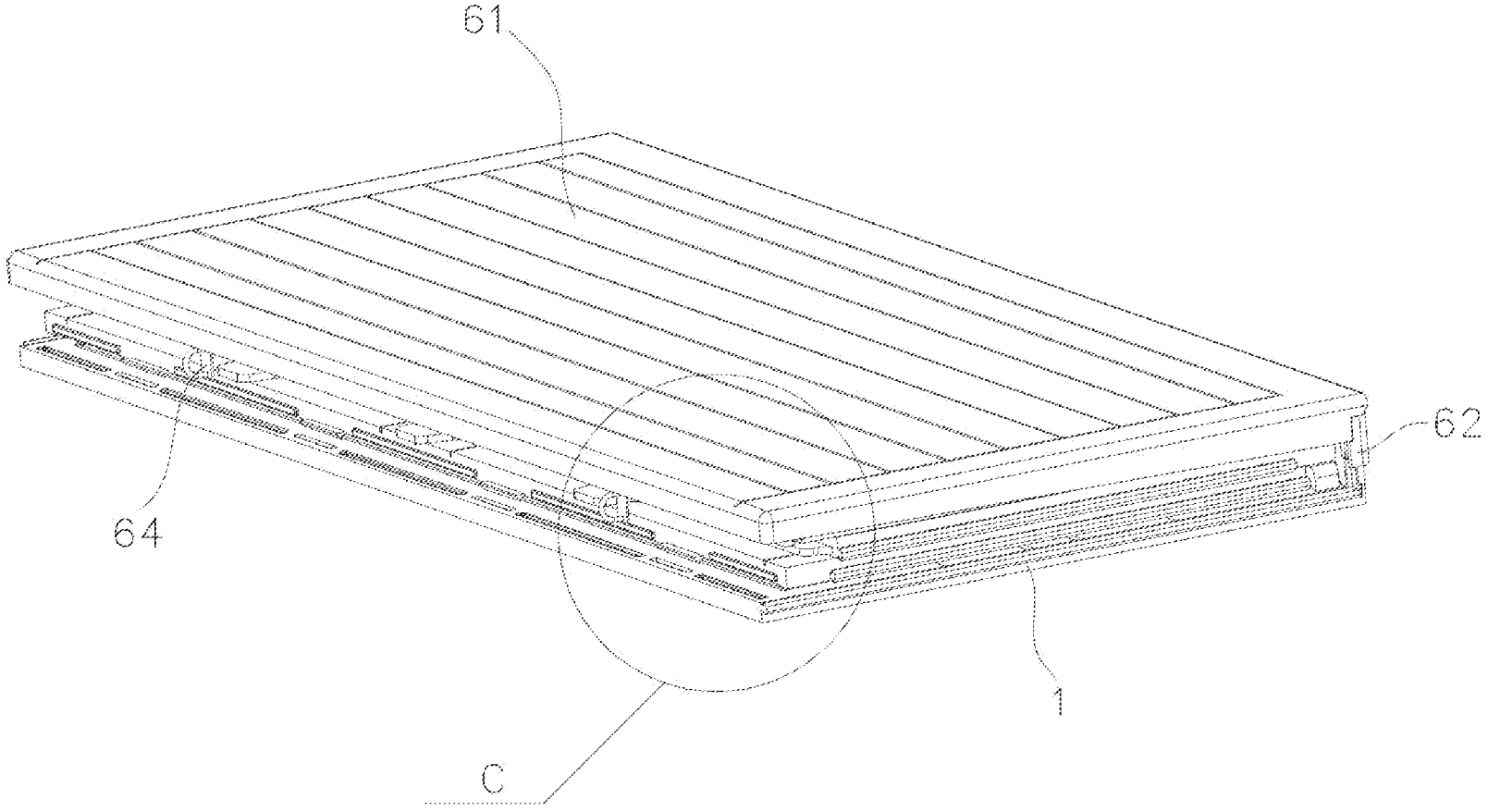
FIG. 15 is a schematic structural view from another angle of FIG. 14.
Figure 16:
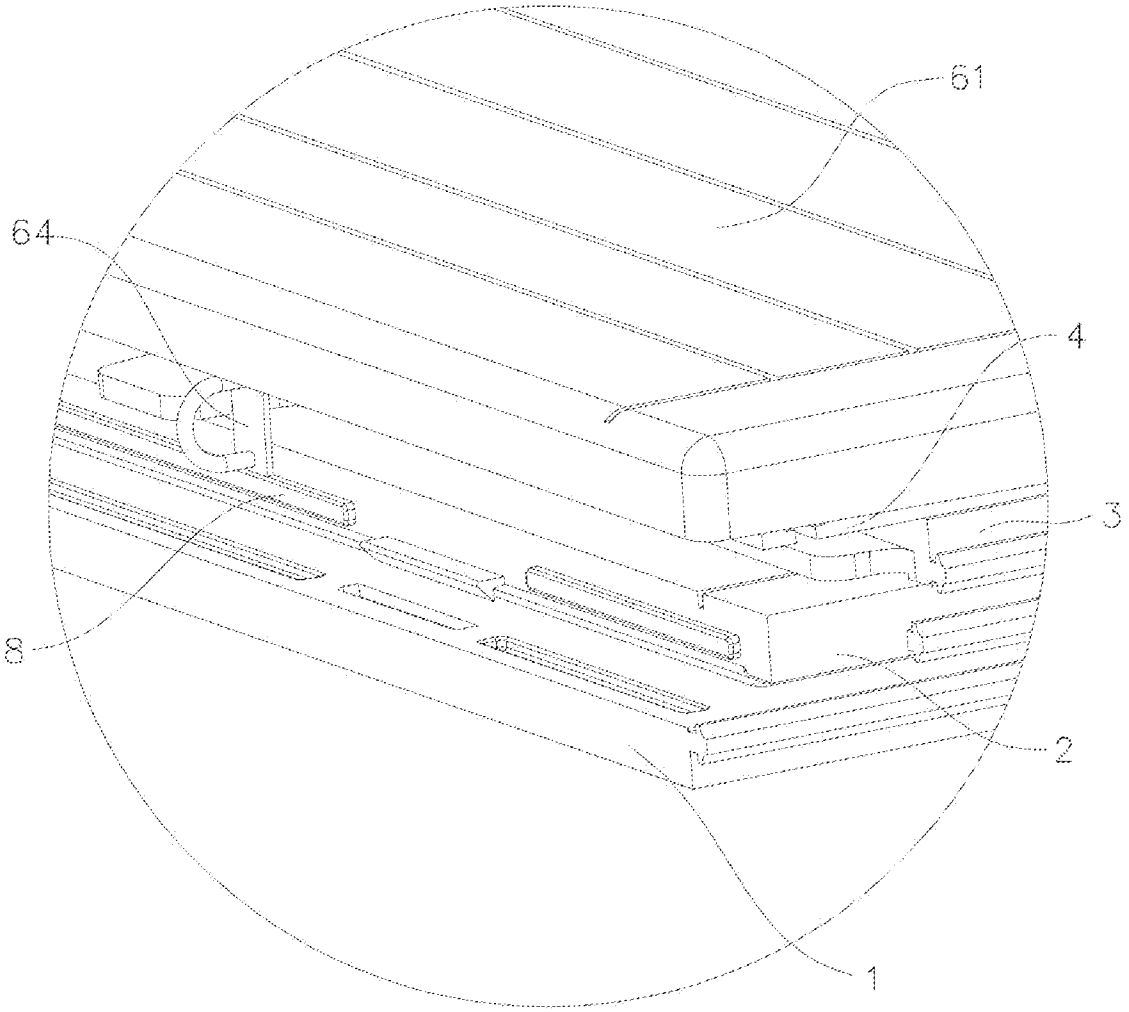
FIG. 16 is an enlarged schematic view of part C in FIG. 15.
Figure 17:
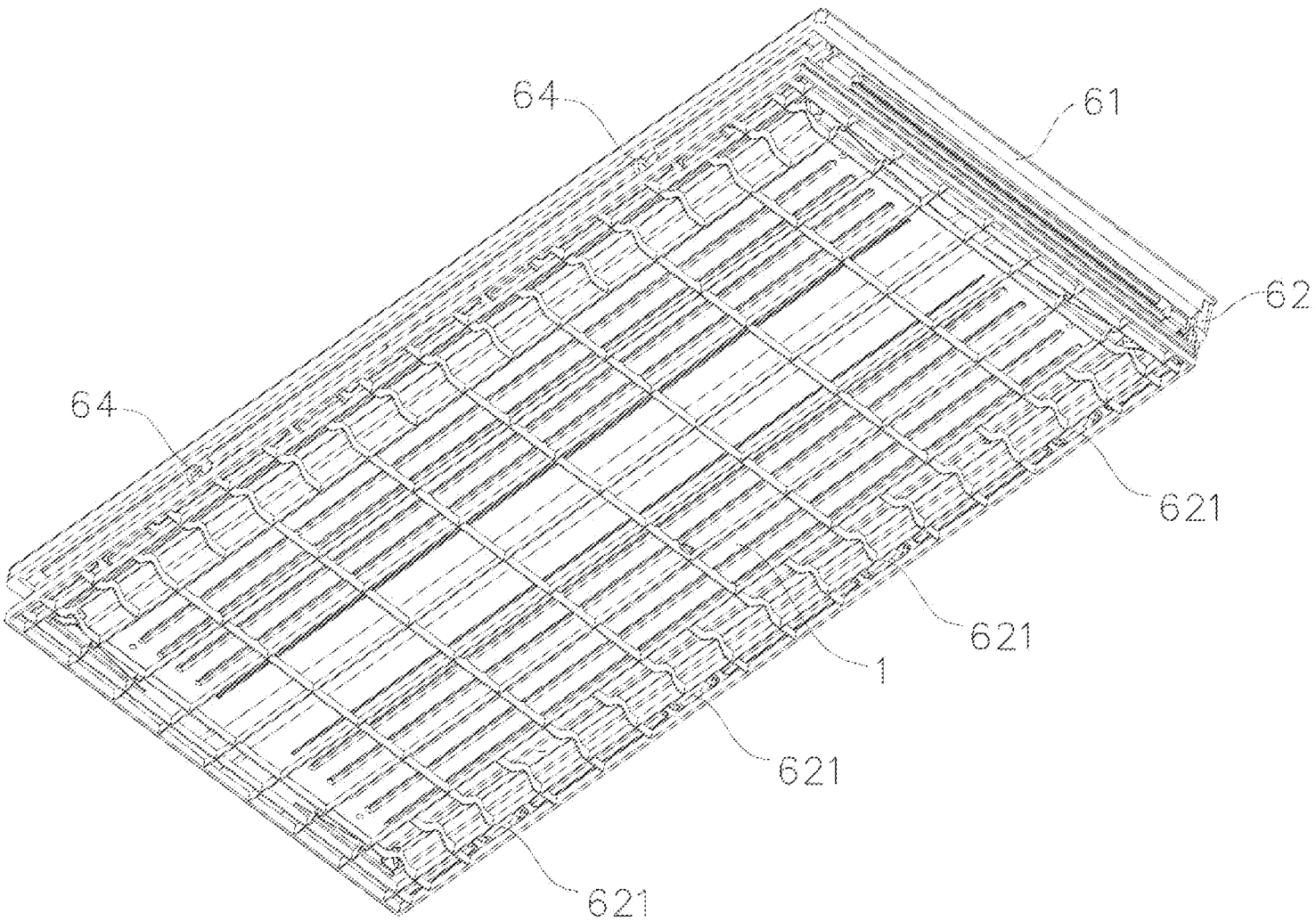
FIG. 17 is a schematic view of FIG. 14 from a different angle.
Figure 18:
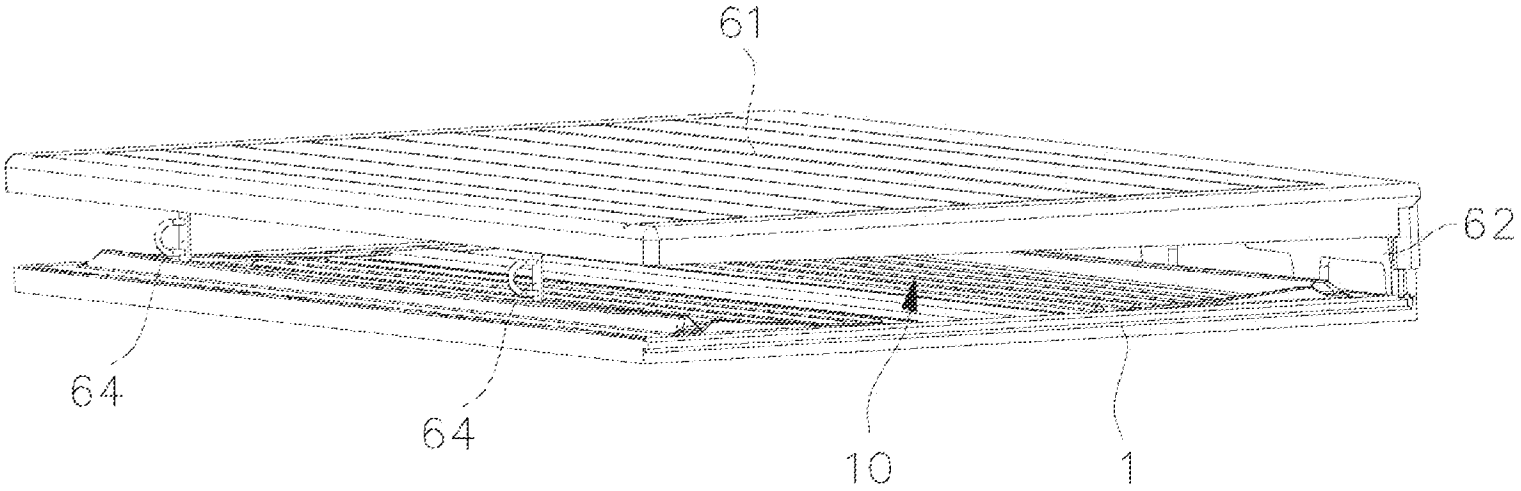
FIG. 18 is a partial schematic view of the storage box in the pre-assembly package state according to an embodiment of the present subject matter.
Figure 19:
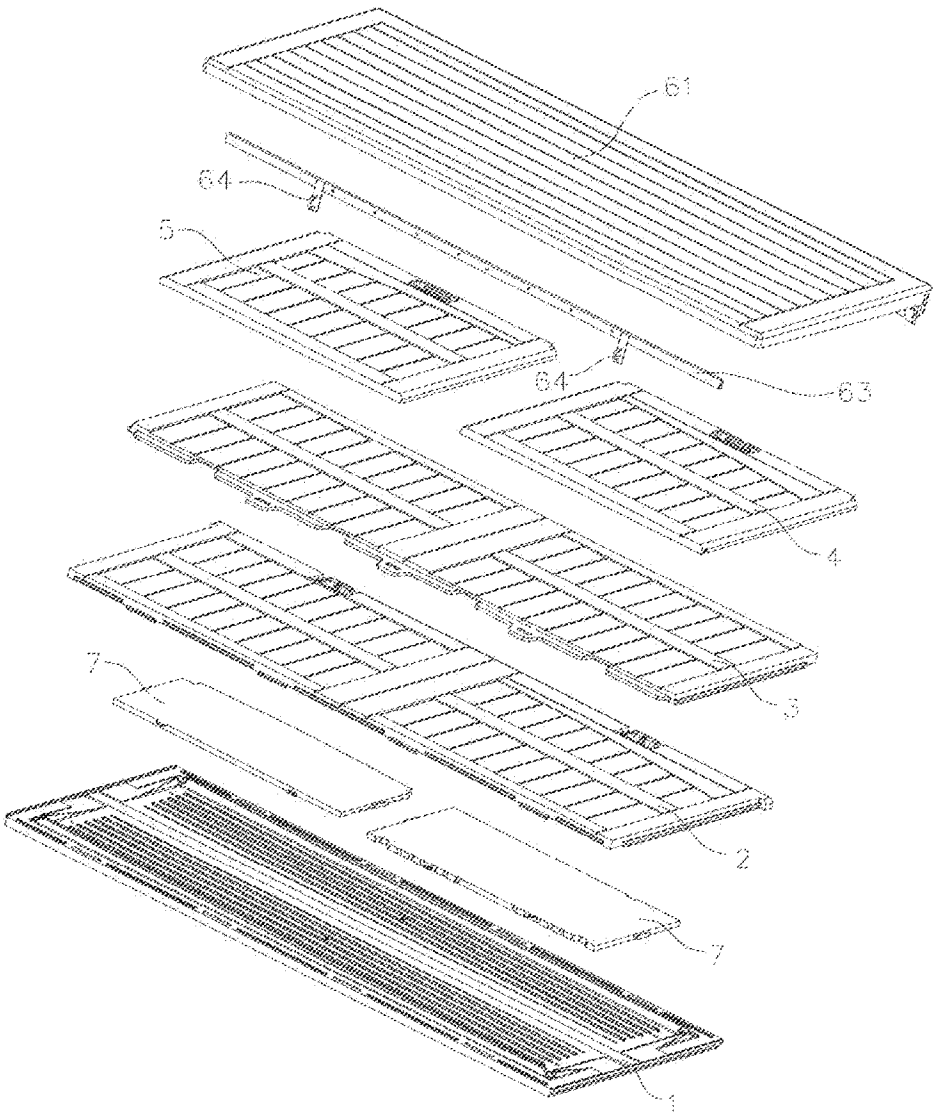
FIG. 19 is a three-dimensional exploded schematic view of the storage box in the pre-assembly package state according to an embodiment of the present subject matter.

As shown in FIGS. 15 and 16, the front board 2 can be arranged horizontally. As shown in FIG. 3, the top of the front board 2 can have a water-retaining strip 8 that can abut the lock 64 on the transverse support rod 73, meaning the abutted parts would limit the rotation of the upper turning portion 61. Furthermore, in the package state, referring to FIGS. 9 and 10, the upper inclined surface 611 can abut against the lower inclined surface 623, the inwardly extending stopper stripes (612) can abut against the stopper bars 624. This would prevent the upper turning portion 61 of the cover board 6 from further inward turning.

Figure 23:
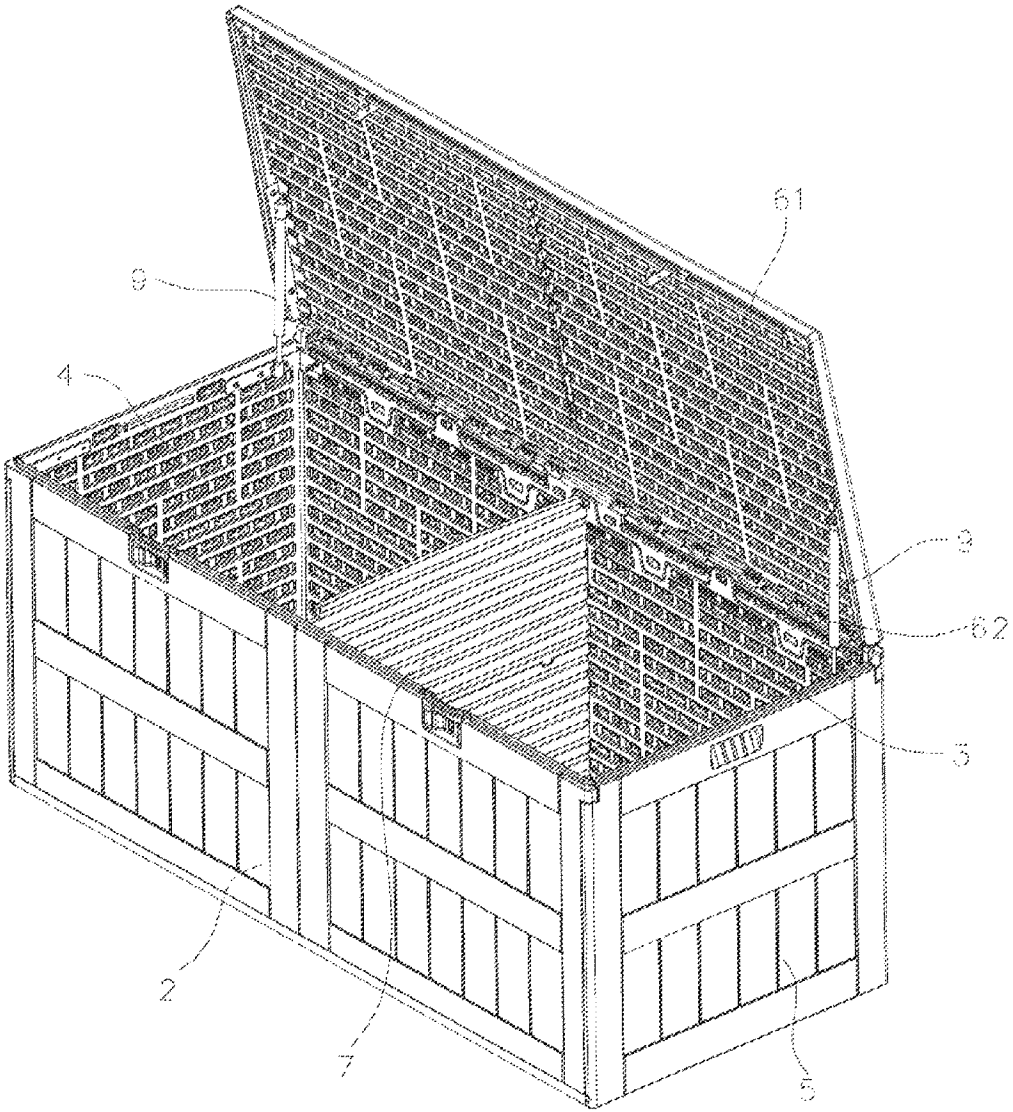
FIG. 23 is another schematic view of the storage box according to an embodiment of the present subject matter.

As shown in FIG. 23, the front board 2, the rear board 3, the left board 4, the right board 5 and the cover board 6 of the storage box can be blow-molded panels with touchpoints on the inner surface. Such touchpoints can enhance the structural strength of the storage box.

It is to be understood that even though numerous characteristics and advantages of various embodiments of the present subject matter have been set forth in the foregoing description, together with details of the structure and function of various embodiments of the subject matter, this disclosure is illustrative only. In some cases, certain subassemblies are only described in detail with one such embodiment. Nevertheless, it is recognized and intended that such subassemblies may be used in other embodiments of the subject matter. Practitioners skilled in the art will recognize many modifications and variations. Changes may be made in detail, especially matters of structure and management of parts within the principles of the embodiments of the present subject matter to the full extent indicated by the broad general meaning of the terms in which the appended claims are expressed.

Having disclosed exemplary embodiments and the best mode, modifications and variations may be made to the disclosed embodiments while remaining within the scope of the embodiments of the subject matter as defined by the following claims.

What is claimed is:

1. A plastic storage box with an integrated hinge structure, comprising:

a bottom board (1), a front board (2), a rear board (3), a left board (4), a right board (5) and a cover board (6), wherein the cover board (6) is divided into an upper turning portion (61) being pivotably connected to a lower portion (62) by an embedded groove hinge (63) formed in the inner side of the cover board (6), and wherein the lower turning portion (62) is detachably-connected to the rear board (3) to form a full rear board of the plastic storage box, wherein first pins (621) and second sockets (622) disposed on the lower side of the lower turning portion (62), first sockets (31) and second pins (32) disposed on the upper side of the rear board (3), wherein the first pins (621) are configured to insert into the corresponding first sockets (31), and the second pins (32) are configured to insert into the corresponding second sockets (622), wherein the inner side of the upper turning portion (61) has an upper inclined surface (611) connected with one side of the embedded groove hinge (63), and wherein the inner side of the lower turning portion (62) has a lower inclined surface (623) connected with the other side of the embedded groove hinge (63), and wherein the upper inclined surface (611) is configured to abut against the lower inclined surface (623) to prevent the upper turning portion (61) and the lower turning portion (62) from collapsing into each other when the upper turning portion (61) and the lower turning portion (62) are perpendicular to each other.

2. The plastic storage box of claim 1, wherein the bottom board (1), the front board (2), the rear board (3), the left board (4) and the right board (5) are detachably connected to their respective adjacent boards.

3. The plastic storage box of claim 1, wherein the first sockets (31) and/or the second sockets (622) further comprise ribs, and the first pins (621) and/or the second pins (32) further comprise grooves, and wherein the ribs are configured to be snapped into the corresponding grooves when the lower turning portion (62) is connected to the rear board (3).

4. The plastic storage box of claim 1, wherein the inner surface of the upper turning portion (61) further comprises inwardly extending stopper stripes (612), and wherein the inner surface of the lower turning portion (62) further comprises stopper bars (624).

5. The plastic storage box of claim 4, wherein the inwardly extending stopper stripes (612) are configured to abut against the stopper bars (624) to prevent the upper turning portion (61) and the lower turning portion (62) from collapsing into each other when the upper turning portion (61) and the lower turning portion (62) are perpendicular to each other.

6. The plastic storage box of claim 1, further comprising:

a vertical partition board (7) within the plastic storage box, wherein the bottom of the vertical partition board (7) is fixed to the bottom board (1), and wherein the top of the vertical partition board (7) abuts against a stripe-shaped rib (613) on the upper turning portion (61) when the cover board (6) is closed.

7. The plastic storage box of claim 6, further comprising:

limiting ribs (11) protrudingly provided on the inner bottom surface of the bottom board (1), limiting slots (71) embedded in the bottom of the vertical partition board (7), wherein the limiting ribs (11) are configured to be inserted into the limiting slots (71).

8. The plastic storage box of claim 1, wherein the front board (2), left board (4) and right board (5) further comprise water resisting strips (8).

9. The plastic storage box of claim 1, further comprising:

a spring (9) connecting each of the left board (4) and the right board (5) with the cover board (6).

* * * * *